United States Patent [19]

Frey et al.

[11] 4,123,105

[45] Oct. 31, 1978

[54] CHAIR CONSTRUCTION

[75] Inventors: Fred J. Frey, Michigan City; Stanley Hynek, Rolling Prairie; Edward Losinski, Michigan City, all of Ind.

[73] Assignee: InterRoyal Corporation, New York, N.Y.

[21] Appl. No.: 769,089

[22] Filed: Feb. 16, 1977

Related U.S. Application Data

[63] Continuation of Ser. No. 626,810, Oct. 29, 1975, abandoned.

[51] Int. Cl.[2] ..... A47C 7/02

[52] U.S. Cl. ..... 297/451; 297/456; 297/DIG. 1

[58] Field of Search ..... 297/451, 450, 445, 455, 297/456, DIG. 1

[56] References Cited

U.S. PATENT DOCUMENTS

| | | | |
|---|---|---|---|
| 3,173,723 | 3/1965 | Hoven et al. | 297/451 |
| 3,669,499 | 6/1972 | Semplonius | 297/455 |
| 3,695,707 | 10/1972 | Barecki | 297/451 X |
| 3,734,561 | 5/1973 | Barecki | 297/DIG. 2 |
| 3,747,978 | 7/1973 | Barecki | 297/445 |
| 3,768,864 | 10/1973 | Niewulls | 297/DIG. 1 |
| 3,788,701 | 1/1974 | Massaccesi | 297/451 |
| 3,797,887 | 3/1974 | Barecki | 297/450 X |
| 3,851,920 | 12/1974 | Harris | 297/451 |

*Primary Examiner*—Roy D. Frazier
*Assistant Examiner*—Peter A. Aschenbrenner
*Attorney, Agent, or Firm*—Arthur A. March

[57] ABSTRACT

A chair or similar article of furniture is presented having front and rear non-load bearing contoured shells of relatively thin plastic molded material secured together to form the seat portion and back portion of a chair or the like. A rigid pre-formed matrix of sturdy, rigid load bearing construction is disposed intermediate the shells. Means are provided for the attachment of arms to the chair.

10 Claims, 4 Drawing Figures

CHAIR CONSTRUCTION

This is a continuation, of application Ser. No. 626,810 filed on Oct. 29, 1975, now abandoned.

BACKGROUND OF THE INVENTION

Heretofore many attempts have been made to provide molded contoured plastic chairs to achieve an outer aesthetically pleasing appearance while nevertheless providing for the essential rigid structure required to accommodate and support the user. Included among such attempts were chairs utilizing molded contoured seating units with a plastic reinforcing mesh secured thereto. Another attempt involved the provision of a chair in which one completely load bearing shell is first molded as one piece and then cut into two portions. Each of the portions is separately upholstered and thereafer the shells are joined together in a manner to conceal the upholstery connections.

Still another attempt to provide such a molded contoured chair structure involved the provision of two shells joined together with the front shell being a load bearing relatively thick structural supporting member and the rear shell being merely trim to conceal the various irregular and unsightly elements required to attach the upholstery to the chair.

While the foregoing attempts have provided some results, the load bearing characteristics thereof are attained only by utilizing expensive relatively thick load bearing high-impact plastic material for the supporting shell. The rigidity and safety of such plastic chairs has been, at times, questionable.

In addition, the expense involved in connection with the utilization of thick load supporting plastic material such as polystyrene of sufficient structural strength has been an important economic factor.

BRIEF DESCRIPTION OF THE INVENTION

The present invention overcomes the foregoing deficiencies and provides a molded plastic contour chair or similar article of furniture which is very pleasing aesthetically and also provides a completely safe supporting structure. Furthermore, the chair is so constructed as to facilitate the adherence of surface cushioning material and upholstery while nonetheless concealing the unsightly fastening points, so as not to disturb the beauty and line of the chair itself.

In accomplishing this result the present invention provides two non-load bearing relatively thin contoured plastic shells which are ultimately secured to each other. Intermediate these plastic shells is a matrix comprising a rigid member, preferably of metal, constructed of rod-like members such as tubes or bars joined to form back and seat supporting portions. The matrix is a complete structural support element and is of sufficient strength to accommodate and support the user even absent the thin front and rear shells. The front and rear thin shells cannot, either individually or together, support a user in the absence of the independent intermediate matrix.

The front shell is so constructed so as to provide channels or recesses to cooperatively accommodate the rod-like members forming the matrix whereby the surface of the matrix parts carried in the channels and the molded plastic portions of the front shell adjacent thereto are substantially flush. The seat portion of the matrix is provided with a seat supporting plate which is in turn fastened by suitable means to a raised portion of similar size in the seat portion of the rear shell and, in turn, to the base support of the chair. A recess in the seat of the front shell accommodates this seat supporting plate when the unit is assembled. Thus a chair is provided in which the contoured seat and back portions comprise only three pieces, viz., a front, comprising a relatively thin contoured non-loading supporting plastic shell; a back, comprising a relatively thin contoured non-load supporting plastic shell; and an intermediate rigid load supporting matrix between the aforesaid two shells.

In the following description, reference will be made specifically to a chair as the article of furniture. It is to be understood, however, that this structure may be applicable to other types of furniture or similar goods which can utilize thin plastic non-load bearing shells with a rigid separate support therebetween.

BRIEF DESCRIPTION OF THE DRAWINGS

Referring to the drawings.

DETAILED DESCRIPTION OF THE INVENTION

Figure 2:
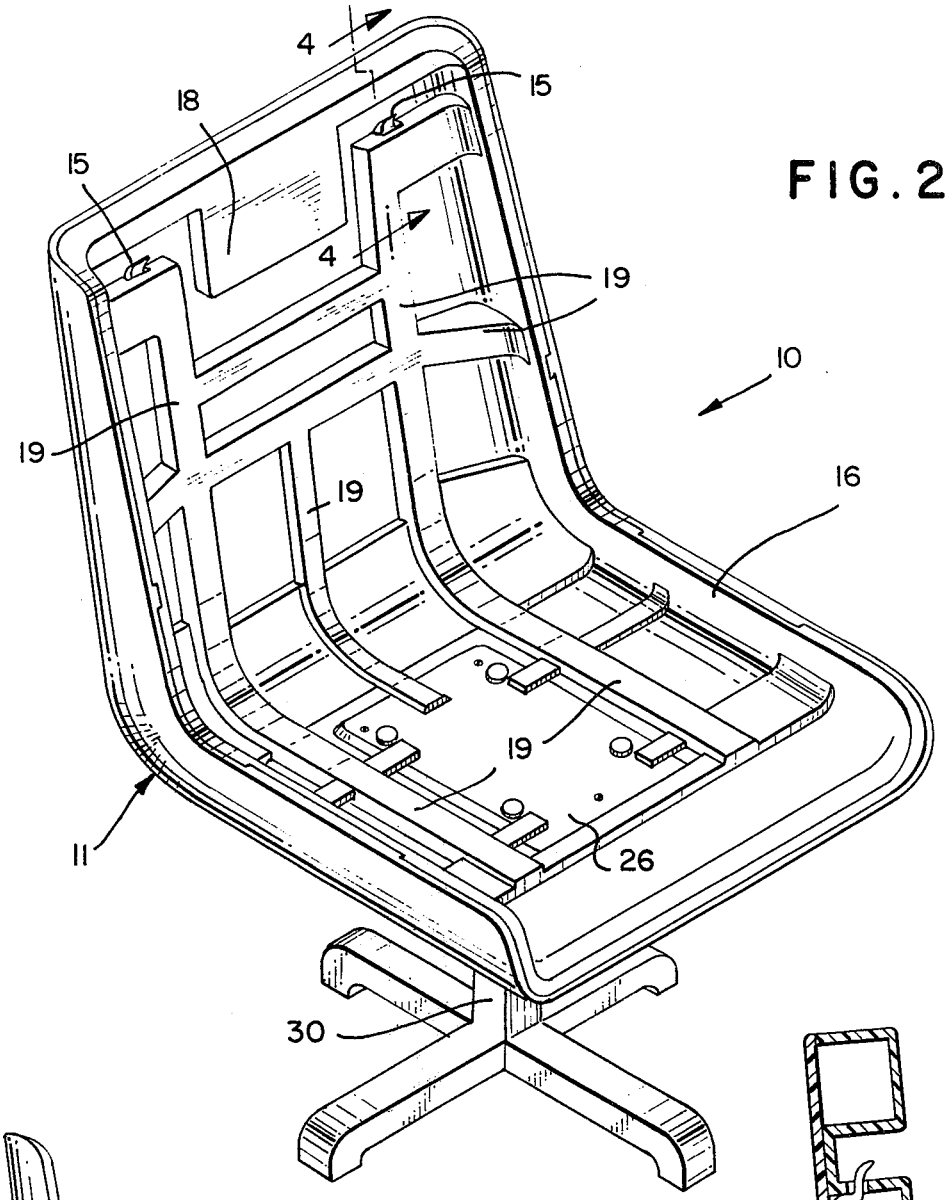
FIG. 2 is a perspective view of the front and rear shells secured together with the intermediate matrix shown in dotted lines.
Figure 1:
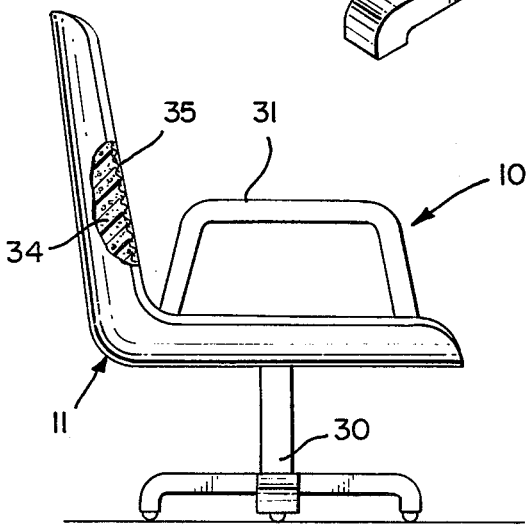
FIG. 1 is a side view partly in section of the chair of the present invention.

The present invention, as illustrated in the drawings, comprises a chair 10 having a contoured molded non-load bearing rear shell 11. The rear shell has a seat portion 12 and a back portion 13. A raised plate section 14 is provided in the seat portion 12 for the purposes hereinafter set forth. The back portion 13 of the chair is also provided with fastening means 15. The outer and exposed back section of this shell is smooth and presents an aesthetically pleasing appearance with an unbroken line look.

The rear shell 11 is made of a suitable plastic material such as one of the various well-known polymers. In and of itself the rear shell is not designed to and does not support the user without danger of collapsing. It is, in fact, a non-load bearing shell.

The chair of the present invention also comprises a front shell 16 having a seat portion 17 and a back portion 18. As is evident from FIGS. 2 and 3, the front shell 16 is molded in such fashion as to provide a series of raised portions 19 which protrude at the front of the shell and which are formed by channels or recesses 20 located in the back of the front shell as shown in a portion of FIG. 3. The channels of this front shell 16 are constructed so as to accommodate the matrix 21 as hereinafter described.

It is to be understood that the front shell 16 is also of a light relatively thin plastic material comprising any one of the well-known polymers. It also is not a load bearing shell and, in fact, would be subject to danger of collapse if an attempt were made to sit upon it independently of the total composite chair structure hereinafter defined. In fact, the shells 11 and 16 even if used together are not, absent additional support, sufficiently sturdy or substantial to sustain the weight of a user without danger of collapse. Each shell individually is a non-load bearing structure and even united they do not provide a load bearing structure. The advantages of this construction are manifold. Among them is, of course, the saving which is effected with the use of a lesser amount of the expensive plastic material. Furthermore, there is a flexibility and ease in handling of these components when the chair is manipulated for assemblage purposes. In addition, because of the construction provided by the invention the assemblage of the entire unit is simple due to the provision of the raised plate 14 and the accommodating channels 20 in the rear of the front shell 16.

A matrix 21 is provided intermediate the two shells 11 and 16. The matrix is formed from a plurality of rod-like members such as formed tubes or bars 22 which are secured to each other as shown to provide a seat portion 23 and back portion 24. This matrix, which bears some resemblance to a basket in shape, is rigid and is in and of itself a load bearing structure being preferably formed of metal or similar rigid and sturdy material. It is so designed that if the user were to sit upon the matrix alone it would bear the weight of the user without any other or additional support or reinforcement. The matrix is so shaped and constructed that the rod like members 22 fit within the channels 20 at the rear of the front shell 16. In this way the outer surfaces of the members 22 are substantially flush with the surface of the non-recessed portions 25 adjacent the channels 20.

Figure 4:
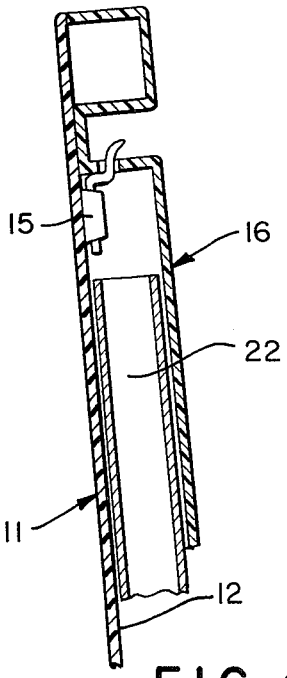
FIG. 4 is a section taken along the lines 4—4 of FIG. 20

Thus, as may be appreciated from FIGS. 2 and 4, the front shell 16 is actually provided with a forward surface having the predominant portion thereof, i.e., at the non-recessed portions 25, disposed rearwardly of the remaining portion thereof, i.e., at such raised portions 19, and the channels 20 at the rear of the front shell are accordingly arranged in corresponding substantial underlying alignment with such remaining portion, i.e., at such raised portions 19. In turn, the rod-like members 22 have a forward supporting matrix surface portion arranged for corresponding substantial underlying alignment with the front shell remaining portion at the raised portions 19 and out of alignment with the predominant portion of the forward surface of such front shell 16 at non-recessed portions 25 as noted above, whereby the rod-like members in the assembled chair orientation are disposed in the channels 20 and the predominant portion of the forward surface of the front shell, at non-recessed portions 25, is disposed rearwardly of and spaced from the forward supporting surface portion of the matrix rod-like members 22.

As shown, the seat portion 23 of the matrix 21 has a plate 26 of such size and shape as to accommodate the raised section 14 of the seat 12 of the shell 11. Cooperating apertures 27 and 28 are respectively disposed for alignment with each other in the plate 26 and the raised portion 14. Additional cooperating apertures 29 are, as shown, disposed in the seat portion of the shell 16. When the chair of the present invention is assembled securing means such as bolts are passed through the apertures 27, 28 and 29 whereby the front shell, matrix and rear shell are joined together. While these parts are secured together at the corresponding seat portions it will be noted that the back portions of the two shells are freely self-disposed in unsecured relation to the matrix (see FIG. 4).

The chair as above described is secured to the conventional base pedestal 30 which need not be described in any detail. There is a plate (not shown) of the usual conventional construction at the top of the pedestal and the plate is secured to the bottom of the seat portion of shell 11 interengaging with raised section 14. The bolts which pass through the apertures in the front shell, matrix and rear shell extend through apertures in the plate on the top of the support pedestal whereby the entire unit may be secured together in the final assembly.

Figure 3:
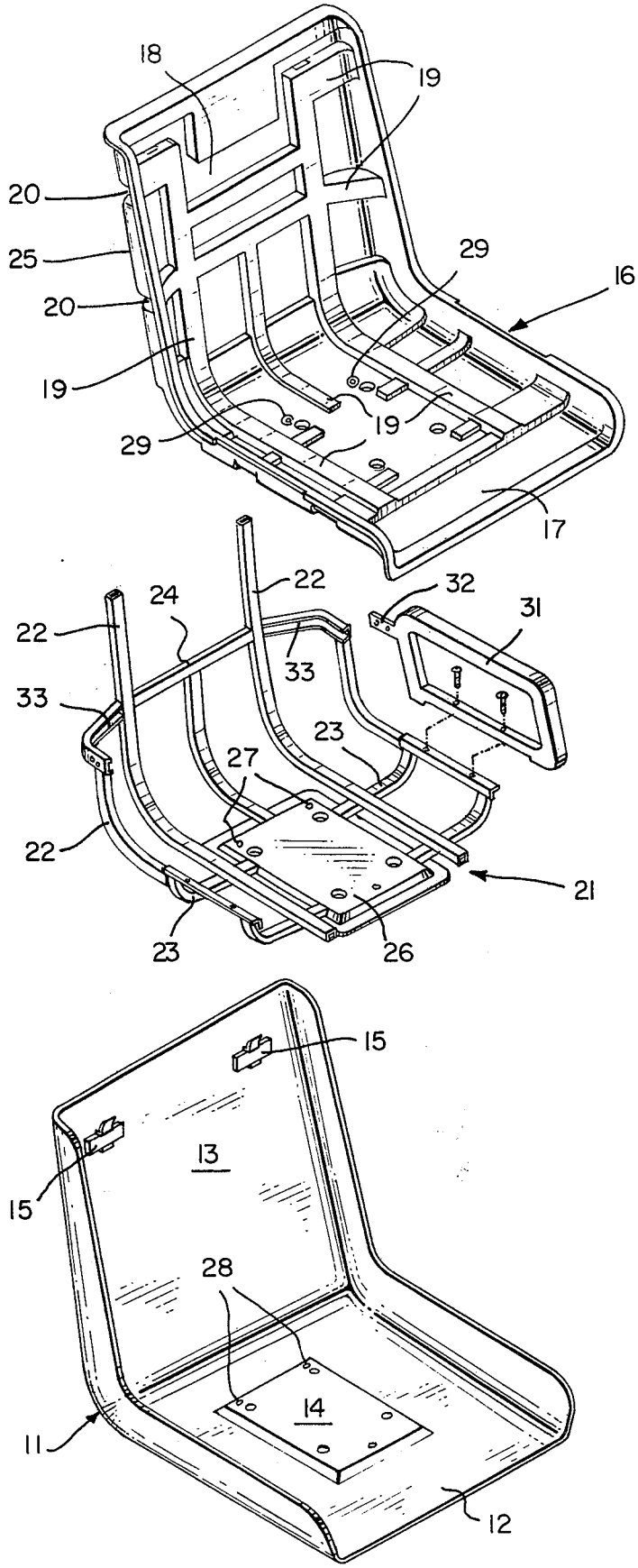
FIG. 3 is an exploded view of the three components of the chair of the present invention comprising the front non-load bearing thin plastic contoured shell.

If desired, arm rests 31 can be provided for the chair. For this purpose, supporting plate 32 and channels 33 are provided which are affixed to the portions of the sides of the rear and seat portions of the matrix as shown in FIG. 3. Bolts are passed through the apertures in the plates 32 and channels 33 as well as aligned apertures in the pertinent cooperating sections of the matrix 21 and arm rests 31. It is thus possible to secure the arm rests near the edges of the seat and back of the chair with ease and facility.

Cushioning material 34 may be applied over the surface of the front shell 16 and upholstery 35 may be suitably applied to cover the cushioning material and the sides and forward portion of the front shell 16. The material may be adhered to the front shell 16 by suitable staples or the like in the customary manner. When such cushioning material 34 and upholstery 35 is applied to the front shell 16, the attaching points will be concealed within the extending frame of the rear shell so that no unsightly connections or ragged edges are at all visible. These details for finishing the chair are facilitated by the basic structure provided by the present invention.

The invention has been described in specific detail in connection with an embodiment thereof. It is to be understood, however, that the reference to a chair is to be construed to apply to any similar piece of furniture or load bearing support to which the structure of present invention is applicable. In addition, variations and modifications may be made without departing from the spirit of the invention as defined in the appended claims.

We claim:

1. A chair or the like comprising:

a front contoured shell having seat and back portions, said shell being provided with a forward surface having the predominant portion thereof disposed rearwardly of the remaining portion of such front surface;

a rear contoured shell having seat and back portions;

an independent intermediate load bearing matrix of sufficient structural strength to support the weight of the user and having a forward supporting matrix surface portion arranged for corresponding substantial underlying alignment with said remaining portion of the forward surface of the front shell and out of alignment with said predominant portion of such forward surface of the front shell, the back portion of said front shell being freely self-disposed in unsecured relation to said matrix and said shells and said matrix being secured together at the corresponding seat portions to provide a chair formation with said predominant portion of the forward surface of the front shell disposed rearwardly of and spaced from said forward supporting surface portion of the matrix, and said front and rear shells individually and together being of insufficient structural strength to support the weight of the user in the absence of the independent intermediate matrix.

2. The invention as defined in claim 1 in which the matrix is formed of a series of joined rod-like members providing seat and back portions.

3. The invention as defined in claim 2 in which the back of the front shell is provided with channels to accommodate the rod-like members therein.

4. The invention as defined in claim 1 in which the front and rear shells are of plastic and the matrix is of metal.

5. The invention as defined in claim 1 including a pedestal support affixed to said chair structure.

6. The invention as defined in claim 1 including arm structures disposed near the edges of the seat and back portions of the chair.

7. The invention as defined in claim 1 including cushioning means and upholstery secured to the front shell.

8. A chair or the like comprising:

a front plastic contoured shell having seat and back portions; said shell being provided with a forward surface having the predominant portion thereof disposed rearwardly of the remaining portion of such front surface and further with channels at the rear thereof arranged in corresponding substantial underlying alignment with said remaining portion;

a rear plastic contoured shell having seat and rear portions;

an independent intermediate load bearing matrix comprising rod-like members forming seat and back portions, and being of sufficient load bearing structural strength by itself to support the weight of the user, said rod-like members having a forward supporting matrix surface portion arranged for corresponding substantial underlying alignment with said remaining portion of the forward surface of the front shell and out of alignment with said predominant portion of such forward surface of the front shell and being disposed in said channels in said front shell, the back portions of said shells being freely self-disposed in unsecured relation to said matrix and said shells and said matrix being secured together at the corresponding seat portions to provide a chair formation with said predominant portion of the forward surface of the front shell disposed rearwardly of and spaced from said forward supporting surface portion of the matrix rod-like members, and said front and rear shells individually and together being of insufficient structural strength to support the weight of the user in the absence of the independent intermediate matrix.

9. The invention as defined in claim 8 in which the seat portion of each shell and matrix are provided with abutting cooperatingly engaging plate sections, said sections being provided with means for securing the shells and the matrix to each other.

10. The invention as defined in claim 9 including a support pedestal for said chair formation having an upper plate adapted to abut the plate section on the seat portion of the rear shell for securement to said chair formation.

* * * * *